US007137583B2

(12) United States Patent
Kammerer

(10) Patent No.: US 7,137,583 B2
(45) Date of Patent: Nov. 21, 2006

(54) STRIKING TOOL FOR COMMINUTING MATERIALS

(75) Inventor: Karl Kammerer, Fluorn-Winzeln (DE)

(73) Assignee: Betek Bergbau- und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 10/993,410

(22) Filed: Nov. 19, 2004

(65) Prior Publication Data

US 2005/0126830 A1 Jun. 16, 2005

(30) Foreign Application Priority Data

Nov. 20, 2003 (DE) ..... 103 54 344

(51) Int. Cl.
*B02C 13/28* (2006.01)

(52) U.S. Cl. ..... 241/294; 241/197; 241/300

(58) Field of Classification Search ..... 241/189.1, 241/195, 197, 294, 300
See application file for complete search history.

(56) References Cited

U.S. PATENT DOCUMENTS 2,077,247 A * 4/1937 McLean ..... 241/294

FOREIGN PATENT DOCUMENTS

DE 93 05 835.7 7/1993
DE 35 45 708 C2 1/1994

* cited by examiner

*Primary Examiner*—Mark Rosenbaum
(74) *Attorney, Agent, or Firm*—Pauley Petersen & Erickson

(57) ABSTRACT

A striking tool for comminuting materials, particularly waste wood, having a shank and a chisel head, wherein a cutting insert is fastened on the chisel head. For an extended service life, along with an improved comminuting output, the cutting insert has at least one first and at least one second cutting element and the first and second cutting elements are arranged one behind the other in the cutting direction.

9 Claims, 2 Drawing Sheets

STRIKING TOOL FOR COMMINUTING MATERIALS

BACKGROUND OF THE INVENTION

1. Field of the Invention

This invention relates to a striking tool, for comminuting materials such as waste wood, having a shank and a chisel head, wherein a cutting insert is fastened on the chisel head.

2. Discussion of Related Art

A striking tool taught by German Patent Reference DE 35 45 708 C2 has a revolving beater to whose base body a releasably connected cutting body is attached. The cutting body is designed as a tooth with a shank. In this case the shank has a cutting head, which generally protrudes in a longitudinal direction out of a cutout of the base body seated so that it can be pivoted in, and has a substantially triangular cross section defining the cutting edge. A predetermined breaking point is defined by a cutout of triangular cross section in the front face of the cutting head, viewed in the circumferential direction, at which the cutting head breaks at a predetermined location in case of an overload, for example because of rocks or other hard items. Here the predetermined breaking point is positioned so that the remaining portion of the cutting head protects the shank and its holder against damage.

This arrangement is disadvantageous for the cutting output of the beater to no longer be provided after the cutting head is broken. In this case the danger of breaking of such a cutting head, which freely protrudes over the base body without a back support, is great, in particular because a weak point of the component has been provided by the predetermined breaking point.

A cutting body with an extended service life is described in German Patent Reference G 93 05 835.7. There, the cutting body is substantially designed as a cast element with a cutting edge extending parallel relative to the axis of rotation, wherein the cutting edge has several partial elements made of hard metal, which are arranged side-by-side and form expendable parts.

This arrangement is disadvantageous because the breaking of a partial element, the cast element of the cutting body located behind it is exposed without protection to the stress exerted by the material to be comminuted. Thus the loss or break of such a partial body quickly results in wearing out of the cast element with the cutout provided for receiving the partial elements.

SUMMARY OF THE INVENTION

It is one object of this invention to provide a striking tool of the type mentioned above but which has an extended service life, along with improved comminution output.

One object of this invention is achieved with a cutting insert having at least one first and at least one second cutting element. The first and second cutting elements are arranged one behind the other in the cutting direction. In case of breaking or loss of one of the front cutting elements, which are mainly exposed to the striking stresses, a cutting element arranged behind it is available, which takes on the cutting work, as well as the mechanical protection of the chisel head located behind it, which is insufficiently strike-proof and wear-proof.

The cutting insert is preferably constructed so that it has two or several first and/or second cutting elements, which are arranged side-by-side transversely with respect to a cutting direction. As a result of the reduced size thus caused, the bending strain on the individual elements is reduced during operations, which leads to a reduced loss because of breaking. Also, with the loss of a cutting element the adjoining elements continue to be available.

If the first and/or the second cutting elements are plate-shaped and have one or more teeth arranged side-by-side transversely with respect to the cutting direction, an improved chip-cutting of fiber-containing materials, such as wood, is achieved.

If the chisel head has a free surface adjoining the cutting insert opposite to the cutting direction, and if the free surface has a profile which is at least partially matched to the outer contour of the cutting insert, the support of the cutting insert is dimensionally stable and retains alignment with the material to be comminuted required, for a good comminution output. Because of its profiling, the chisel head does not have additional resistance to the material to be comminuted.

A lasting and dimensionally stable holding of the cutting element of the cutting insert on the chisel head is achieved because the chisel head has a receiver for the cutting insert, which has two support surfaces extending at an angle with respect to each other. The first support surface substantially extends in the cutting direction. The first and second cutting elements are supported on this support surface. The second cutting element, which is arranged behind the first cutting element in the cutting direction, is supported with its back at the second support surface, and the back of the first cutting element is supported at the front of the second cutting element.

In one embodiment, the first and second cutting elements are made of hard materials of different quality. Thus, the first cutting element, in front in the circumferential direction, can be made of a more valuable resistant material, while the rear cutting element can be made of a cost-effective material.

A dimensionally stable support of the cutting device, along with the simultaneous prevention of jamming of the striking tool, is achieved because the chisel head has a free surface which is inclined with respect to the cutting direction and adjoins the cutting insert opposite to the cutting direction. The first cutting element makes a transition via the second cutting element into the free surface.

BRIEF DESCRIPTION OF THE DRAWINGS

This invention is explained in greater detail in view of an exemplary embodiment represented in the drawings, wherein.

DESCRIPTION OF PREFERRED EMBODIMENTS

Figure 1:
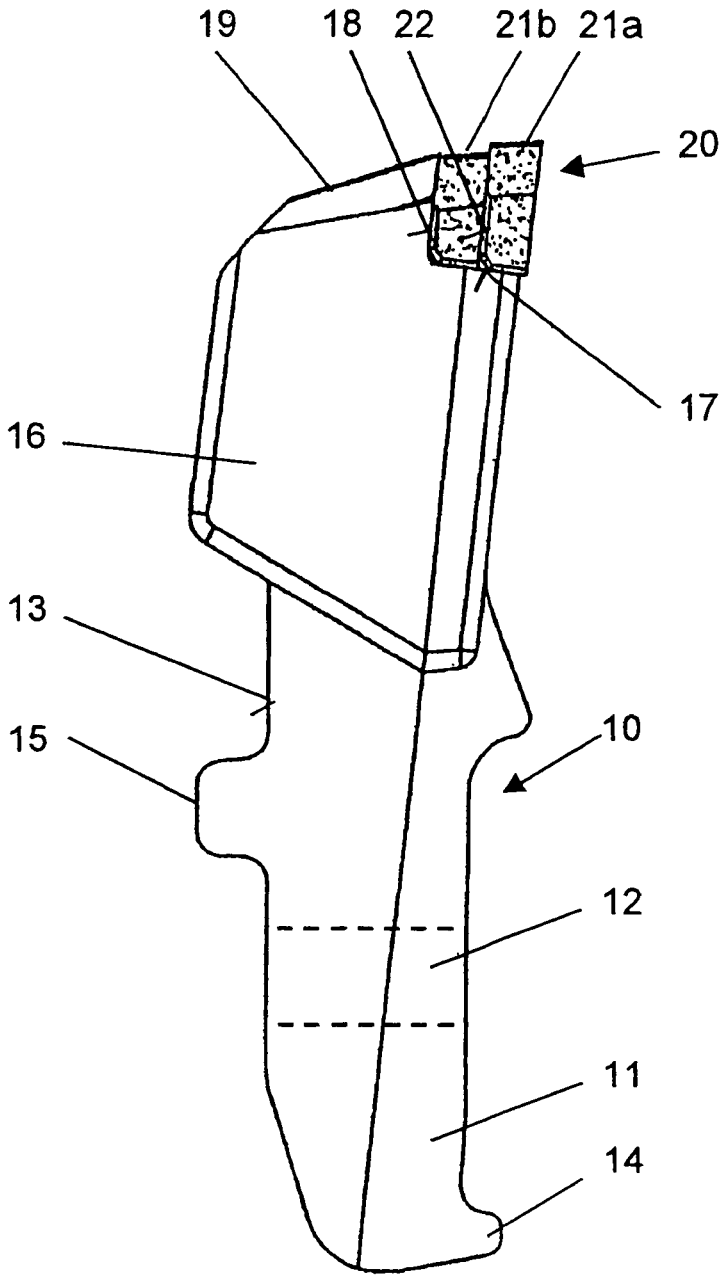
FIG. 1 shows one embodiment of a striking tool in a lateral view.

FIG. 1 shows a striking tool 10 with a shank 11 and a chisel head 16 connected with the shank 11, in a lateral view. The striking tool 10 is fastened by a bolt, not shown, which is guided through a fastening bore 12, on a rotating beater, also not shown. Besides the bolt, protrusions 14, 15 are used for the releasable holding of the striking tool 10 on the beater and for the transmission of the forces occurring during operations. A clamping surface 13 is also used for transferring the forces to the beater. The chisel head 16 connected with the shank 11 supports a cutting insert 20, which is composed of the cutting elements 21*a* and 21*b*, which are located one behind the other in the working direction. The rear cutting element 21*b* is connected at a rear portion with the chisel head 16 via a support surface 16, and at an underside via a support surface 17, for example soldered together and can be made of a material of reduced quality with respect to the front cutting element 21*a*, because it is only employed when the latter fails. The front cutting element 21*a* is connected at a rear with the rear cutting element 21*b* via a contact surface 22, and at its underside with the chisel head 16 via a support surface 17, for example with solder. The front cutting element 21*a* makes a transition without a shoulder via the rear cutting element 21*b* to a free surface 19. The free surface 19 is inclined relative to the cutting or feed direction. In the area of or near the contact surface 22, the front cutting element 21*a* protrudes as a shoulder-like element beyond the rear cutting element 21*b*, so that it transitions into the free surface via a step.

Figure 2:
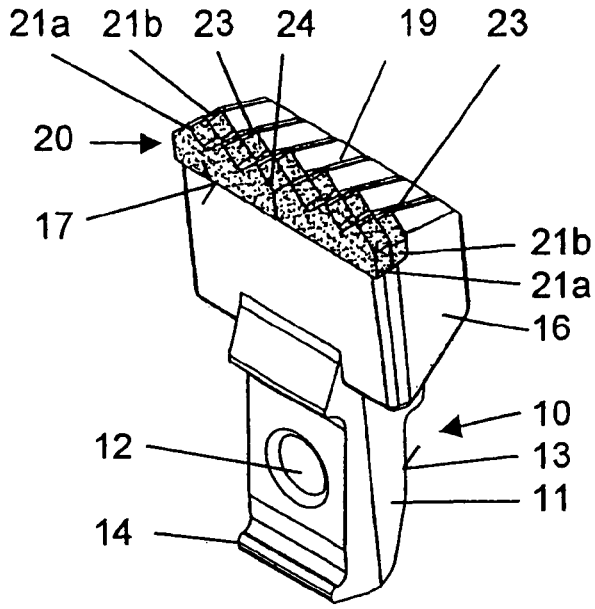
FIG. 2 shows the striking tool of FIG. 1, in a perspective front plan view.

FIG. 2 shows the striking tool 10 with the chisel head 16 widened with respect to the shank 11. The fastening bore 12 is cut into the shank 11. The chisel head 16 supports the cutting insert 20, wherein the front working face has two front cutting elements 21*a*, which have a common contact surface 24. Each of the front cutting elements has teeth 23, which improve the comminuting output. The teeth are arranged at an identical pitch with respect to each other.

In the embodiment shown, the front cutting elements 21*a* are identically shaped, so that a cost-effective manufacture is possible. Teeth are also formed into the rear cutting elements 21*b*. Here the front cutting elements 21*a* and the rear cutting elements 21*b* are oriented so that the teeth 23 are arranged congruently in the direction of rotation one behind the other. The rear cutting elements 21*b* also have a common contact surface 24.

Figure 3:
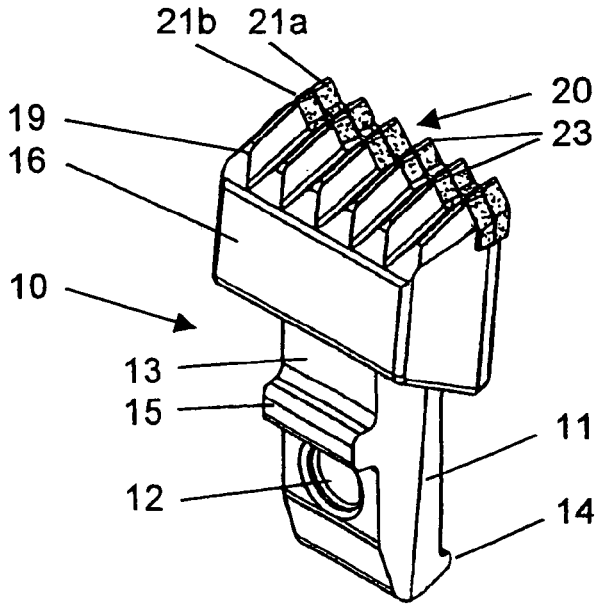
FIG. 3 shows the striking tool of FIG. 1, in a perspective rear plan view.

FIG. 3 shows the striking tool 10 in a perspective plan rear view. The free surface 19 of the chisel head 16 is profiled to correspond to the shape of the teeth 23 of the cutting insert 20. With this the cutting insert 20 is effectively supported without becoming jammed by the material to be comminuted. The clamping face 13, the protrusion 15 and the fastening bore 12 can be used to assemble the striking tool 10.

German Patent Reference 103 54 344.9-23, the priority document corresponding to this invention, and its teachings are incorporated, by reference, into this specification.

What is claimed is:

1. A striking tool for comminuting materials including waste wood, comprising:

a chisel head (16) connected to a shank (11);

a cutting insert (20) fastened on the chisel head (16);

the cutting insert (20) having at least one first cutting element (21*a*) and at least one second cutting element (21*b*);

the first cutting element (21*a*) and the second cutting element (21*b*) arranged one behind the other in a cutting direction;

wherein at least one of the first cutting elements (21*a*) and the second cutting elements (21*b*) are plate-shaped and have at least one tooth (23) arranged side-by-side transversely with respect to the cutting direction, and wherein the chisel head (16) has a free surface (19) adjoining the cutting insert (20) opposite to the cutting direction, and the free surface (19) has a profile at least partially matched to an outer contour of the cutting insert (20).

2. The striking tool in accordance with claim 1, wherein the cutting insert has at least one of two of the first cutting elements (21*a*) and two second cutting elements (21*b*) arranged side-by-side transversely with respect to the cutting direction.

3. The striking tool in accordance with claim 2, wherein the chisel head (16) has a receiver for the cutting insert (20) which has two support surfaces (17, 18) extending at an angle with respect to each other, wherein the first support surface (17) substantially extends in the cutting direction, the first and the second cutting elements (21*a*, 21*b*) are supported on the support surface (17), each of the second cutting elements (21*b*) arranged behind the first cutting element (21*a*) in the cutting direction and supported with a back at the second support surface (18), and a back of the first cutting element (21*a*) supported at a front of the second cutting element (21*b*).

4. The striking tool in accordance with claim 3, wherein the first and second cutting elements (21*a*, 21*b*) are made of different quality hard materials.

5. The striking tool in accordance with claim 4, wherein the chisel head (16) has a free surface (19) inclined with respect to the cutting direction and adjoining the cutting insert (20) opposite to the cutting direction, and the first cutting element (21*a*) makes a transition via the second cutting element (21*b*) into the free surface (19).

6. The striking tool in accordance with claim 1, wherein the chisel head (16) has a receiver for the cutting insert (20) which has two support surfaces (17, 18) extending at an angle with respect to each other, wherein the first support surface (17) substantially extends in the cutting direction, the first and the second cutting elements (21*a*, 21*b*) are supported on the support surface (17), each of the second cutting elements (21*b*) arranged behind the first cutting element (21*a*) in the cutting direction and supported with a back at the second support surface (18), and a back of the first cutting element (21*a*) supported at a front of the second cutting element (21*b*).

7. The striking tool in accordance with claim 1, wherein the first cutting element (21*a*) is made of a first hard material and the second cutting element (2*b*) is made of a second hard material, and the first and second hard materials are different quality hard materials.

8. The striking tool in accordance with claim 1, wherein the chisel head (16) has a free surface (19) inclined with respect to the cutting direction and adjoining the cutting insert (20) opposite to the cutting direction, and the first cutting element (21*a*) makes a transition via the second cutting element (21*b*) into the free surface (19).

9. The striking tool in accordance with claim 1, wherein the first cutting element (21*a*) and the second cutting element (21*b*) are soldered together and to the chisel head 16.

* * * * *